US010281211B2

(12) United States Patent
Savarese

(10) Patent No.: US 10,281,211 B2
(45) Date of Patent: May 7, 2019

(54) DRYING APPARATUS AND METHODS

(71) Applicant: Columbia PhytoTechnology, LLC, The Dalles, OR (US)

(72) Inventor: Mark Savarese, Hood River, OR (US)

(73) Assignee: International Flavors & Fragrances Inc., New York, NY (US)

( * ) Notice: Subject to any disclaimer, the term of this patent is extended or adjusted under 35 U.S.C. 154(b) by 253 days.

(21) Appl. No.: 14/729,929

(22) Filed: Jun. 3, 2015

(65) Prior Publication Data

US 2015/0267964 A1 Sep. 24, 2015

Related U.S. Application Data

(60) Continuation of application No. 11/982,208, filed on Oct. 31, 2007, now Pat. No. 9,068,777, which is a (Continued)

(51) Int. Cl.

| | |
|---|---|
| ***F26B 3/34*** | (2006.01) |
| ***F26B 13/10*** | (2006.01) |
| ***F26B 3/28*** | (2006.01) |
| ***F26B 3/30*** | (2006.01) |
| ***F26B 17/02*** | (2006.01) |
| ***F26B 17/04*** | (2006.01) |

(52) U.S. Cl.

CPC ..... *F26B 13/10* (2013.01); *F26B 3/28* (2013.01); *F26B 3/305* (2013.01); *F26B 17/023* (2013.01); *F26B 17/04* (2013.01)

(58) Field of Classification Search

CPC .. F26B 3/28; F26B 3/30; F26B 17/023; F26B 17/026

USPC ..... 34/266, 268, 269

See application file for complete search history.

(56) References Cited

U.S. PATENT DOCUMENTS 2,155,453 A * 4/1939 Stuntz ..... A23B 7/028 159/8

2,299,725 A 10/1942 Argabrite (Continued)

OTHER PUBLICATIONS

Abonyi, B.I.; Feng, H.; Tang, J.; Edwards, C.G., Evaluation of Energy Efficiency and Quality Retention for the Refractance Window Drying System, Research Report, published online, Dec. 30, 1999, pp. 1-38.

(Continued)

*Primary Examiner* — John P McCormack

(74) *Attorney, Agent, or Firm* — Klarquist Sparkman, LLP

(57) ABSTRACT

Apparatus and method for drying a product comprising placing the product on a first side of a support surface, and directing dry radiant heat toward the second side of the surface to heat the product. A sensor can be included to measure at least one characteristic of the product, such as the temperature or moisture content thereof. The temperature of the heat source can be regulated as a function of the measured characteristic. The support surface can also be made so as to be movable relative to the heat source. In an alternative embodiment, a plurality of control zones are defined and through which the product is successively passed. Each of the control zones has at least one associated heat source and an associated sensor so as to regulate the temperature of the heat sources associated with each control zone independently of those associated with another zone.

29 Claims, 6 Drawing Sheets

Related U.S. Application Data division of application No. 10/367,465, filed on Feb. 14, 2003, now Pat. No. 7,441,344, which is a division of application No. 09/757,323, filed on Jan. 9, 2001, now Pat. No. 6,539,645.

(56) References Cited

U.S. PATENT DOCUMENTS

| | | | | |
|---|---|---|---|---|
| 2,301,589 | A | 11/1942 | Shepard | |
| 2,405,813 | A * | 8/1946 | Blanchard | D06C 7/00 34/266 |
| 2,442,407 | A | 6/1948 | Gibbons et al. | |
| 2,454,370 | A | 11/1948 | Beaubien | |
| 2,668,364 | A | 2/1954 | Colton | |
| 2,722,749 | A | 11/1955 | Dargert | |
| 2,848,931 | A | 8/1958 | Troidl | |
| 3,031,313 | A | 4/1962 | Morgan et al. | |
| 3,266,169 | A | 8/1966 | Smith, Jr. | |
| 3,432,937 | A | 3/1969 | Stevens et al. | |
| 3,520,066 | A | 7/1970 | Meade | |
| 3,570,576 | A * | 3/1971 | Griffon | F26B 17/023 159/8 |
| 3,589,028 | A | 6/1971 | Hinton | |
| 3,619,326 | A * | 11/1971 | Burbidge | B65C 9/1869 156/384 |
| 3,972,127 | A | 8/1976 | Hoshi et al. | |
| 4,169,007 | A | 9/1979 | Pray | |
| 4,204,337 | A | 5/1980 | Roos et al. | |
| 4,308,897 | A | 1/1982 | Westhead | |
| 4,337,083 | A | 6/1982 | Sweat | |
| 4,498,996 | A | 2/1985 | Klemarczyk | |
| 4,631,837 | A * | 12/1986 | Magoon | A23B 7/028 34/353 |
| 4,915,154 | A | 4/1990 | Persson | |
| 4,945,212 | A | 7/1990 | Gogan et al. | |
| 5,135,122 | A * | 8/1992 | Gross | A23L 3/0055 219/685 |
| 5,167,079 | A | 12/1992 | Bowen | |
| 5,323,546 | A * | 6/1994 | Glover | F26B 3/283 34/267 |
| 5,341,580 | A | 8/1994 | Teal | |
| 5,373,647 | A | 12/1994 | Bernes et al. | |
| 5,377,428 | A | 1/1995 | Clark | |
| 5,449,883 | A | 9/1995 | Tsuruta | |
| 5,465,504 | A | 11/1995 | Joiner | |
| 5,523,106 | A | 6/1996 | Gimmler et al. | |
| 5,636,318 | A | 6/1997 | Polaert et al. | |
| 5,656,179 | A * | 8/1997 | Gehrmann | B01D 33/04 210/771 |
| 5,678,323 | A * | 10/1997 | Domingue | F26B 17/205 34/209 |
| 5,735,009 | A | 4/1998 | Saito et al. | |
| 5,738,892 | A | 4/1998 | Takaoka | |
| 5,743,022 | A * | 4/1998 | Hall Taylor | A24B 3/14 34/216 |
| 5,937,535 | A | 8/1999 | Hoffman et al. | |
| 6,223,451 | B1 * | 5/2001 | Satake | F26B 9/087 34/134 |
| 6,539,645 | B2 | 4/2003 | Savarese | |
| 7,441,344 | B1 | 10/2008 | Saverese | |
| 2003/0150128 | A1 * | 8/2003 | Macaluso | F26B 3/283 34/397 |

OTHER PUBLICATIONS

Abonyi, B.I.; Feng, H.; Tang, J.; Edwards, C.G.; Chew, B.P.; Mattinson, D.S.; Fellman, J.K., Quality Retention in Strawberry and Carrot Purees Dried with Refractance Window System, *Journal of Food Science*, 2002, 67, 1051-1056.

AC Nielsen Homescan, How Expensive Are Fruits and Vegetables?, How Much Do Americans Pay for Fruits and Vegetables/AIB-790, Economic Research Service, USDA, 1999, pp. 11-23.

Barbosa-Cánovas, G.V.; Vega-Mercado, H., *Dehydration of Foods*; Chapman & Hall, 1996; pp. 2-3.

Barbosa-Cánovas, G.V.; Vega-Mercado, H., *Dehydration of Foods*, Chapman & Hall, 1996 pp. 80-82.

Barbosa-Canovas, G.V.; Ortega-Rivas, E.; Juliano, P.; Yan, H., *Food Powders, Physical Properties, Processing, and Functionality*, Kluwer Academic/Plenum Publishers, 2005, pp. 337-338.

Beuchat, L.R. Water Activity and Microbial Stability, Center for Food Safety and Dept. of Food Science and Technology, University of Georgia. Published online at http://www.wateractivity.org/BeuchatIFT2002.pdf, 2002, 35 pgs.

Chakraborty, M.; Savarese, M.; Harbertson, E.; Harbertson, J.; Ringer, K.L. Effect of the Novel Radiant Zone Drying Method on Anthocyanins and Phenolics of Three Blueberry Liquids, *Journal of Agricultural and Food Chemistry*, 2010, 58, pp. 324-330.

Chegini, G.R.; Ghobadian, B., Spray Dryer Parameters for Fruit Juice Drying. *World Journal of Agricultural Sciences*, 2007, 3(2), pp. 230-236.

Earle, R. L. In *Unit operations in food processing*, Chapter 7 Drying, Web Edition. 2004 http://www.nzifst.org.nz/unitoperations/drying.htm. Accessed date: Jul. 13, 2009.

Goula, A.M.; Adamopoulos, K.G., Stability of Lycopene During Spray Drying of Tomato Pulp; *Food Science and Technology*, 38, 2005, pp. 479-487.

Goula, A.M.; Adamopoulos, K.G. Retention of Ascorbic Acid during Drying of Tomato Halves and Tomato Pulp. *Drying Technology*, 2006, 24, 57-64.

Liu, Y.; Zhao, Y., Feng, X. Exergy analysis for a freeze-drying process. *Applied Thermal Engineering*, 2008, 28, 675-690.

Mujumdar, A.S.; Huang, L.X., Global R&D Needs in Drying, *Drying Technology*. 2007, 25, pp. 647-658.

Nindo, C.I.; Feng, H.; Shen, C.Q., Tang, J.; Kang, D.H., Energy Utilization and Microbial Reduction in a New Film Drying System, Published online at http://www.impact.wsu.edu/publications/tech_papers/pdf/02-106.pdf.

Ratti, C., Hot air and freeze-drying of high-value foods: a review, *Journal of Food Engineering*, 2001, 49, pp. 311-319.

Rininger, J.A.; Ringer, K.; Savarese, M., In Vitro Immunopharmacology of Echinacea, In Echinacea: The genus *Echinacea*. 2004 Miller, S.C., Ed. CRC Press, Boca Raton, FL, pp. 169-180.

Setiady, D.; Tang, J.; Younce, F.; Swanson, B.A.; Rasco, B.A.; Clary, C.D. Porosity, Color, Texture and Microscopic Structure of Russet Potatoes Dried Using Microwave Vacuum, Heated Air, and Freeze Drying, *Applied Engineering in Agriculture*, 2009, 25(5), pp. 719-724.

Strumillo, C. Perspectives on Developments in Drying, *Drying Technology*, 24, 2006, 1059-1068.

Tsami, E.; Krokida, M.K.; Drouzas, A.E. Effect of Drying Method on the Sorption Characteristics of Model Fruit Powders, *Journal of Food Engineering*, 1999, 38, pp. 381-392.

Wojdylo, A.; Figiel, A.; Oszmianski, J., Effect of Drying Methods with the Application of Vacuum Microwave on the Bioactive Compounds, Color, and Antioxidant Activity of Strawberry Fruits, *Journal of Agricultural and Food Chemistry*, 2009, 57, pp. 1337-1343.

Wu H, Chakraborty M, Savarese M, Ringer K, (Manuscript in preparation. Will be submitted for publication in 2011 in Berry Health Special Edition of *Journal of Agricultural and Food Chemistry*), Evaluation of the Radiant Zone Drying Method on Strawberry Puree and a Comparison with Freeze Drying, pp. 1-23.

Zhang, M.; Tang, J.; Mujumdar, A.S.; Wang, S., Trends in microwave-related drying of fruits and vegetables, *Trends in Food Science and Technology*, 2006, 17, pp. 524-534.

Office Action from the United States Patent & Trademark Office in co-pending U.S. Appl. No. 11/982,208, dated Jun. 10, 2009.

Office Action from the United States Patent & Trademark Office in co-pending U.S. Appl. No. 11/982,208, dated Apr. 14, 2010.

Office Action from the United States Patent & Trademark Office in co-pending U.S. Appl. No. 11/982,208, dated Nov. 30, 2010.

Office Action from the United States Patent & Trademark Office in co-pending U.S. Appl. No. 11/982,208, dated Dec. 20, 2011.

Office Action from the United States Patent & Trademark Office in U.S. Appl. No. 13/421,492, dated Jun. 5, 2012.

(56) References Cited

OTHER PUBLICATIONS

Office Action from the United States Patent & Trademark Office in co-pending U.S. Appl. No. 11/982,208, dated Nov. 28, 2012.
Office Action from the United States Patent & Trademark Office in U.S. Appl. No. 13/421,492, dated Apr. 1, 2013.
Office Action from the United States Patent & Trademark Office in co-pending U.S. Appl. No. 11/982,208, dated Jul. 2, 2013.
Office Action from the United States Patent & Trademark Office in U.S. Appl. No. 13/421,492, dated Dec. 5, 2013.
Office Action from the United States Patent & Trademark Office in co-pending U.S. Appl. No. 11/982,208, dated Jun. 10, 2014.
Office Action from the United States Patent & Trademark Office in U.S. Appl. No. 13/421,492, dated Jun. 20, 2014.
Notice of Allowance from the United States Patent & Trademark Office in U.S. Appl. No. 13/421,492, dated Sep. 16, 2014.
Notice of Allowance from the United States Patent & Trademark Office in U.S. Appl. No. 13/421,492, dated Jan. 22, 2015.
Notice of Allowance from the United States Patent & Trademark Office in co-pending U.S. Appl. No. 11/982,208, dated Feb. 25, 2015.

* cited by examiner

DRYING APPARATUS AND METHODS

CROSS REFERENCE TO RELATED APPLICATIONS

The present application is a continuation of U.S. patent application Ser. No. 11/982,208, filed on Oct. 31, 2007, which is a divisional application of U.S. patent application Ser. No. 10/367,465, issued as U.S. Pat. No. 7,441,344, filed on Feb. 14, 2003, which is a divisional of U.S. patent application Ser. No. 09/757,323, issued as U.S. Pat. No. 6,539,645, filed on Jan. 9, 2001, all of which are incorporated herein by reference.

FIELD

The present invention relates to methods and apparatus for drying a product, and more specifically, to methods and apparatus for drying a product which is in the form of a liquid or paste by removing moisture there from.

BACKGROUND

Prior art drying apparatus and methods have been utilized for drying organic products which are in the form of liquids or semi-liquids such as solutions and colloidal suspensions and the like. These prior art drying apparatus have been used primarily to produce various dried or concentrated foodstuffs and food-related products, as well as nutritional supplements and pharmaceuticals. The liquid products are usually first processed in a concentrator apparatus which employs a high-capacity heat source, such as steam or the like, to initially remove a portion of the moisture from the suspension. Then, the concentrated products are often processed in a prior art drying apparatus in order to remove a further portion of the remaining moisture.

Various types of prior art drying apparatus have been employed, including spray dryers and freeze dryers. While spray dryers are known to provide high processing capacity at a relatively low production cost, the resulting product quality is known to be relatively low. On the other hand, freeze dryers are known to produce products of high quality, but at a relatively high production cost.

In addition to spray dryers and freeze dryers, various forms of belt dryers have been used. Such prior art drying apparatus generally include an elongated, substantially flat, horizontal belt onto which a thin layer of product is spread. The product is usually either in the form of a concentrated liquid or a semi-liquid paste. As the belt slowly revolves, heat is applied to the product from a heat source. The heat is absorbed by the product to cause moisture to evaporate there from. The dried product is then removed from the belt and collected for further processing, or for packaging, or the like.

A typical prior art apparatus and method is disclosed in U.S. Pat. No. 4,631,837 to Magoon. Referring to FIGS. 1 and 2 of the '837 patent which are reproduced in the drawings which accompany the instant application as Prior Art FIGS. 1 and 2, an elongated frame or structure is provided on which an elongated water-tight trough 10 is supported. The trough 10 is preferably made of ceramic tile. An insulation layer 12 is provided on the outer surface of the trough 10. The interior surface of the trough 10 is lined with a thin polyethylene sheet 16. Parallel rollers 24, 26 are provided, with one roller being located at each end of the trough 10. One of the rollers 26 is driven by a motor.

A water heater 15 and circulation system, including a pump and related piping, is also provided with the prior art apparatus of the '837 patent. The water heater 15 is configured to heat a supply of water 14 to just below its boiling point, or slightly less than 100 degrees C. The pump and related piping system is configured to circulate the water 14 through the trough 10 so that a minimum given water depth is maintained throughout the trough. In addition, the water heater 15 and related circulation system is configured to maintain the water supply within the trough at a temperature which is slightly less than 100 degrees C.

A flexible sheet of polyester, infra-red transparent material 18 in the form of an endless belt is supported about the rollers 24, 26 at each end, and is also supported on top of the water supply 14 within the trough 10. That is, the polyester belt 18 is driven by the roller 26 and revolves there about and the roller 24, while floating on the water 14 within the trough 10. A thin layer of liquid product 20 is dispensed onto the revolving belt 18 by way of a product discharge means 28 which is located at an intake end of the apparatus.

As the layer of product 20 travels along the trough 10 on the belt 18 which floats on-the water 14, the product is heated by the water 14 which is maintained near 100 degrees C., and on which the belt 18 floats. The heat from the water 14 drives moisture from the product 20 until the product reaches the desired dryness, whereupon the product is removed from the belt 18. The rate at which the belt 18 moves through the trough 10 can be regulated so that the product 20 will reach its desired dryness at the discharge end of the apparatus where it is removed there from.

Several characteristics of the drying apparatus and method disclosed by the '837 patent lead to inconvenient and troublesome use of the apparatus. For example, the trough 10 of a typical prior art apparatus as disclosed by the '837 patent has a length within the range of 12 to 24 meters or more. As a result, the apparatus occupies a relatively large amount of production space. Also, several potential problems regarding the operation of the prior art apparatus can be attributed to the use of water as a heat source.

For example, the prior art apparatus requires a relatively massive water heating and circulation system 15 for its operation. The water heating and circulation system 15 can prove troublesome in several ways. First, the water heating and circulation system 15 adds complexity to the configuration and construction of the apparatus as well as to its operation. The system 15 incorporates a water heater, a pump, and various pipes and valves which must all be maintained in a relatively leak-proof manner. The required water heating and circulation system 15 can also deter the ease of mobility of the prior art dryer because of the bulky nature of the system and because of the need for a water supply.

Secondly, the water 14, which is maintained below the boiling point, can serve as a harbor for potentially dangerous microbial organisms which can cause contamination of the product 20. Thirdly, the presence of a large amount of water 14 can serve to counter the objective of the prior art apparatus which is to remove moisture from the product 20. That is, the water 14, by way of inevitable leaks and evaporation from the trough 10, can enter the product 20 thereby increasing the drying time of the product.

Moreover, because the water 14 is the sole source of heat for drying of the product 20, and because the water temperature is maintained below 100 degrees C., the process of drying of the product 20 is relatively slow. As a universally accepted rule, the quantity of heat transferred between two bodies is proportional to the difference in the temperature of each of the bodies. Also, as a general rule, the moisture contained in the product to be dried must absorb a relatively great amount of energy in order to vaporize. The product 20 initially contains a relatively high amount of moisture when it is initially spread onto the support surface 18. Thus, a relatively high amount of heat energy is required to vaporize the moisture and remove it from the product 18.

However, because the temperature of the water heat source of the prior art apparatus never exceeds 100 degrees C., the difference in the temperatures of the heat source and the product 20 is limited which, in turn limits the transfer of heat to the product. As the product 20 absorbs heat from the heat source, the temperature of the product will rise. This rise in temperature of the product as it travels through the apparatus results in an even lower difference in temperature between the product 20 and heat source which, in turn, further reduces the amount of heat transfer from the heat source to the product. For this reason, the prior art apparatus often requires extended processing times in order to satisfactorily remove moisture from the product 20.

Also, the prior art apparatus and method of the '837 patent does not provide for any flexibility in processing temperatures because the temperature of the heat source cannot be easily changed, if at all. For example, the production of some products can benefit from specific temperature profiles during the drying process. The "temperature profile" of a product refers to the temperature of the product as a function of the elapsed time of the drying process. However, because the temperature of the heat source of the prior art apparatus is not only limited to 100 degrees Centigrade, but also slow to change, the temperature profile of the product cannot be easily controlled, or changed.

Because the prior art apparatus disclosed by the '837 patent employs water as a heat source, and requires a large water heating system for its operation, the resulting prior art apparatus is large, heavy, immobile, complex, difficult to maintain, and can be a source of microbial contamination of the product. Additionally, because the temperature of the water heat source utilized by the prior art method and apparatus is limited to less than 100 degrees Centigrade, the prior art method of drying can be slow and inefficient, and does not provide for modification or close control of the product temperature profile.

Therefore it has long been known that it would be desirable to provide a method and apparatus which achieve the benefits to be derived from similar prior art devices, but which avoid the shortcomings and detriments individually associated therewith.

SUMMARY

In accordance with a first embodiment of the invention, an apparatus generally includes a support surface which substantially allows radiant heat to pass there through. The support surface is configured to support a product on a first side thereof, while a dry radiant heat source is exposed to the second side of the support surface. A gap separates the radiant heat source from the support surface. The radiant heat source can direct radiant heat toward the second side which heat passes through the support surface so as to be absorbed by the product for drying thereof. A sensor can be located in a position which is exposed to the first side of the support surface. The sensor is configured to detect and measure at least one characteristic of the product, such as its temperature, moisture content, chemical composition or the like. The measured characteristic can be employed to regulate the temperature, and thus the heat output, of the heat source. Various other embodiments of drying apparatus in accordance with the instant invention which are similar to the first embodiment are discussed as well.

In accordance with a fifth embodiment of the invention, an apparatus includes an elongated chassis, and a support surface movably supported on the chassis. The support surface can preferably be configured as an endless belt which is configured to be moved, or driven, by an actuator. A heater bank, which comprises at least a first dry radiant heat source and a second dry radiant heat source, is supported on the chassis so as to be exposed to the second side of the support surface and to direct radiant heat thereto. A gap separates the heater bank from the support surface. An opposite first side of the support surface is configured to support a product and move the product through a plurality of control zones in succession. At least a first control zone and a second control zone are included in the apparatus. The temperature of each heat source within a given control zone can be regulated independently of the temperature of any other heat source which is outside the given control zone. A plurality of sensors which are configured to detect and measure at least one characteristic of the product can also be included. The sensors can be employed to provide feedback for the regulation of the temperatures of each of the heat sources.

In accordance with a sixth embodiment of the invention, a method of drying a product is provided. The method includes providing a support surface having a first side and an opposite second side. The product is placed on the first side of the surface and radiant heat is directed across a gap to the second side of the surface to dry the product thereon.

BRIEF DESCRIPTION OF THE DRAWINGS

Preferred embodiments of the invention are described below with reference to the following accompanying drawings.

DETAILED DESCRIPTION

The present invention provides for methods and apparatus for drying a product containing moisture. The apparatus generally includes a support surface which is substantially transparent to radiant heat. The product is supported on a first side of the support surface while radiant heat is directed toward a second side of the support surface to heat the product for drying. The apparatus can also generally include a sensor which is configured to detect and measure at least one characteristic of the product, such as temperature or moisture content. The measurement of the product characteristic can be used to regulate the temperature of the heat source so as to radiate a desired quantity of heat to the product.

Figure 1:
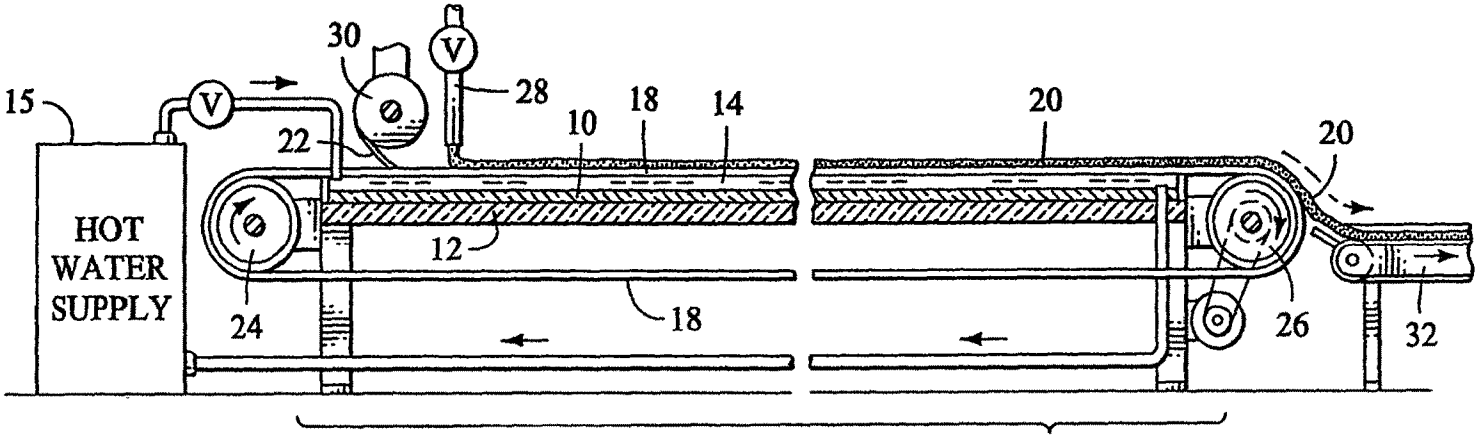
FIG.1 PRIOR ART
FIG. 1 is a side elevation diagram of a prior art apparatus.
Figure 2:
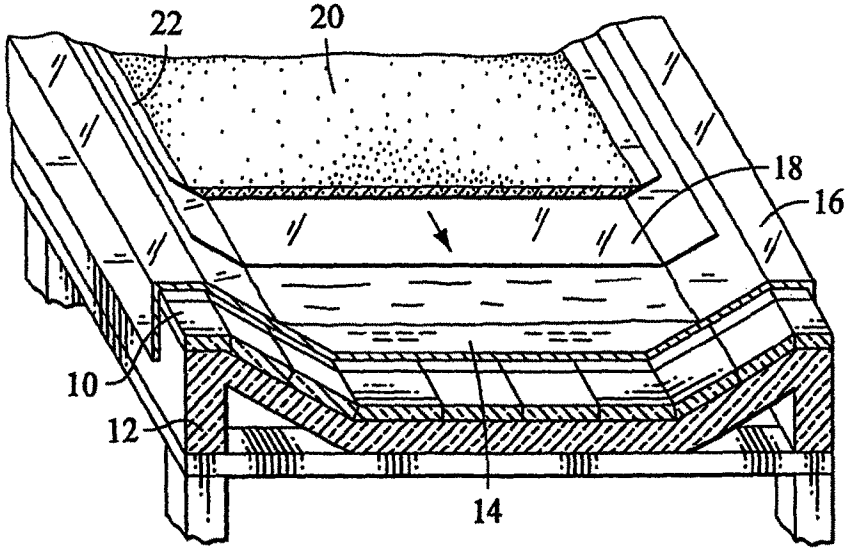
FIG.2 PRIOR ART
FIG. 2 is a partial perspective of the prior art apparatus depicted in FIG. 1.
Figure 3:
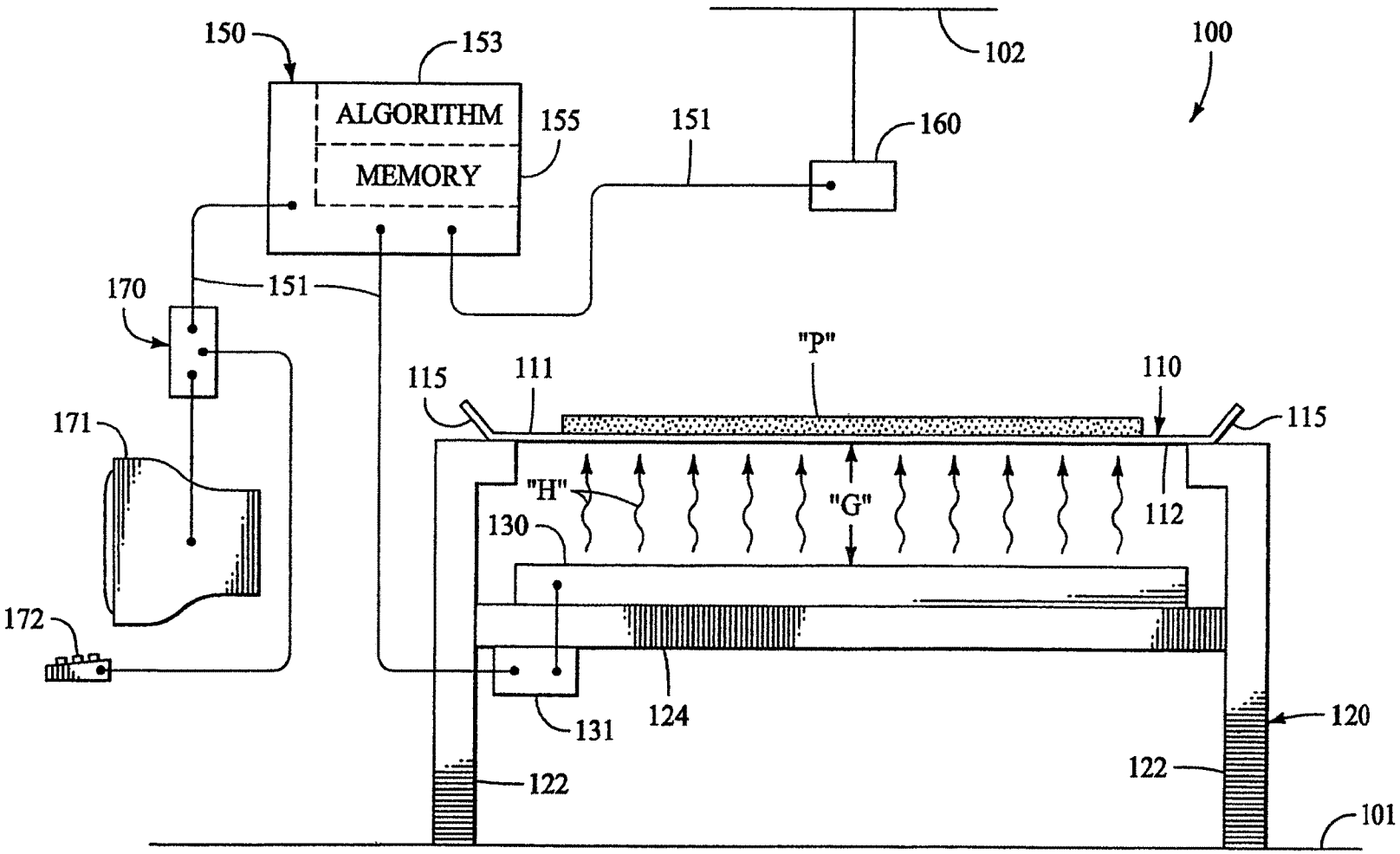
FIG. 3 is a side elevation diagram of an apparatus in accordance with a first embodiment of the present invention.

Referring to FIG. 3, a side elevation view of a basic drying apparatus 100 in accordance with a first embodiment of the present invention is depicted. The drying apparatus 100 is generally configured to remove a given amount of moisture from a product "P" to dry or concentrate the product. The product "P" can be in any of a number of types, including aqueous colloidal suspensions, or the like, which can be in the form of a liquid or paste, and from which moisture is to be removed there from by heating. The product "P" is generally spread, or otherwise placed, onto the apparatus 100 for drying. Once the product "P" has reached the desired dryness, it is then removed from the apparatus 100.

The apparatus comprises a support surface 110 onto which the product "P" is placed for 10 drying. The support surface 110 has a first side 111 which is configured to support a layer of the product "P" thereon as shown. The support surface also has second side 112 which is opposite the first side 111. Preferably, the first side 111 is substantially flat and supported in a substantially horizontal manner so that, in the case of a liquid product "P," a substantially even layer thereof is formed on the first side. In addition, lips 115 can be formed on the edges of the support surface 110 for the purpose of preventing the product "P" from running off the first side 111 of the support surface.

The support surface 110 can be configured as a substantially rigid tray or the like as shown. However, in an alternative embodiment of the present invention which is not shown, the support surface 110 can be a relatively thin, flexible sheet which is supported by a suitable support system or the like. The support surface 110 is configured to allow radiant heat to pass there through from the second side 112 to the first side 111. The term "radiant heat" means heat energy which is transmitted from one body to another by the process generally known as radiation, as differentiated from the transmission of heat from one body to another by the processes generally known as conduction and convection.

The support surface 110 is fabricated from a material which is substantially transparent to radiant heat and also able to withstand temperatures of up to 300 degrees Fahrenheit. Preferably, the support surface 110 is fabricated from a material comprising plastic. The term "plastic" means any of various nonmetallic compounds synthetically produced, usually from organic compounds by polymerization, which can be molded into various forms and hardened, or formed into pliable sheets or films.

More preferably, the support surface 110 is fabricated from a material selected from the group consisting of acrylic and polyester. Such materials, when utilized in the fabrication of a support surface 110, are known to have the desired thermal radiation transmission properties for use in the present invention. Further, plastic resins can be formed into a uniform, flexible sheet, or into a seamless, endless belt, which can provide additional benefits.

Also, such materials are known to provide a smooth surface for even product distribution, a low coefficient of static friction between the support surface 110 and the product "P" supported thereon, flexibility, and resistance to relatively high temperatures. In addition, such materials are substantially transparent to radiant heat, have relatively, high tensile strengths, and are relatively inexpensive and easily obtained.

The apparatus 100 can also comprise a chassis 120. The chassis is preferably rigidly constructed and can include a set of legs 122 which are configured to rest on a floor 101 or other suitable foundation, although the legs can also be configured to rest on bare ground or the like. The chassis 120 can also include a bracket 124, or the like, which is configured to support thereon a dry radiant heat source 130 which is exposed to the second side 112 of the support surface 110.

The term "exposed to" means positioned such that a path, either direct or indirect, can be established for the transmission of radiant heat energy, wave energy, or electromagnetic energy between two or more bodies. The heat source 130 is configured to direct radiant heat "H" across a gap "G" and toward the second side 112 of the support surface 110.

The term "dry radiant heat source" means a device which is configured to produce and emit radiant heat, as well as direct the radiant heat across a gap to another body, without the incorporation or utilization of any liquid heating medium or substance of any kind, including water. The term "gap" means a space which separates two bodies between which heat is transferred substantially by radiation and wherein the two bodies do not contact one another.

Since the apparatus 100 does not employ water, or other liquid, as a heating source or heating medium, the apparatus 100 is greatly simplified over prior art apparatus which do employ liquid heating media. In addition, the absence of a liquid heat medium in the apparatus 100 provides additional benefits.

For example, the absence of a water heating medium decreases likelihood of microbial contamination of the product "P" as well as the likelihood of re-wetting the product. Moreover, the absence of liquid heating medium and associated eating/pumping system enables the apparatus 100 to be moved and set up relatively easily and quickly which can provide benefits in such applications as on-site field harvest/processing.

The dry radiant heat source 130 is preferably configured to direct radiant heat "H" toward the second side 112 of the support surface 110. Preferably, the dry radiant heat source 130 is positioned relative to the support surface 110 such that the second side 112 thereof is directly exposed to the radiant heat source. However, in an alternative embodiment of the present invention which is not shown, reflectors or the like can be employed to direct the radiant heat "H" from the radiant heat source 130 to the second side 112 of the support surface 110. Also, although it is preferable for the heat source 130 to be positioned so as to direct heat "H" toward the second side 112, it is understood that the heat source can be positioned so as to direct heat toward the first side 111, and thus directly at the product "P" in accordance with other alternative embodiments of the present invention which are not shown.

Preferably, the radiant heat source 130 is configured to operate using either electrical power or gas. The term "gas" means any form of combustible fuel which can include organic or petroleum based products or by-products which are either in a gaseous or liquid form. More preferably, the radiant heat source 130 is selected from the group consisting of gas radiant heaters, and electric heaters. The term "gas radiant heaters" means devices which produce substantially radiant heat by combusting gas. The term "electric radiant heaters" means devices which produce substantially radiant heat by drawing electrical current. Various forms of such heaters are known in the art. The use of such heaters as the heat source 130 can be advantageous because of the several benefits associated therewith.

For example, such heaters can attain high temperatures and can produce large quantities of radiant heat energy. Such heaters can attain temperatures of at least 100 degrees Centigrade and can attain temperatures significantly greater than 100 degrees Centigrade. The high temperatures attainable by these heaters can be beneficial in producing large amounts of heat energy. In addition, the temperature of the heater, and thus the amount of radiant heat energy produced, can be relatively quickly changed and can be easily regulated by proportional modulation thereof. Also, such heaters generally tend to be relatively light in weight compared to other heat sources, and are generally resistant to shock and vibration.

Since electric radiant heaters such as quartz heaters and ceramic heaters draw electrical power for operation, such heaters can be operated either from a portable generator, or from a permanent electrical power grid. Similarly, radiant gas heaters can be operated either from a portable gas supply, such as a liquified natural gas tank, or from a gas distribution system such as an underground pipeline system. Furthermore, heaters such as those discussed above are generally known to provide long, reliable operating life and can be serviced easily.

The radiant heat source 130 is preferably configured to reach a temperature greater than 100 degrees, Centigrade, and more preferably, the heat source is configured to reach a temperature significantly greater than 100 degrees, Centigrade, such as 150 degrees, Centigrade. The radiant heat source 130 can be configured to vary the amount of radiant heat that is directed toward the support surface 110. That is, the radiant heat source 130 can be configured to modulate the amount of heat that it directs toward the support surface 110.

Preferably, the radiant heat source 130 can be configured modulate so that the temperature thereof can be increased or decreased in a rapid manner. The heat source 130 can be configured to modulate by employing an "on/off" control scheme. Preferably, however, the heat source can be configured to modulate by employing a true proportional control scheme.

To facilitate the operational control of the heat source 130, the apparatus 100 can include a control device 131 which is connected to the heat source. The control device 131 can be an electrical relay as in the case of an electrically powered heat source 130. Alternatively, the control device 131 can be a servo valve as in the case of a gas powered heat source 130.

The support surface 110 can be configured to be movable with respect to the radiant heat source 130. For example, the support surface 110 can be configured as a movable tray which can be placed onto, and removed from, the chassis 120 as shown in FIG. 3. In an alternative configuration of the first embodiment of the invention, the chassis 120 can include rollers or the like on which the support surface 110 can be supported and moved.

Figure 3A:
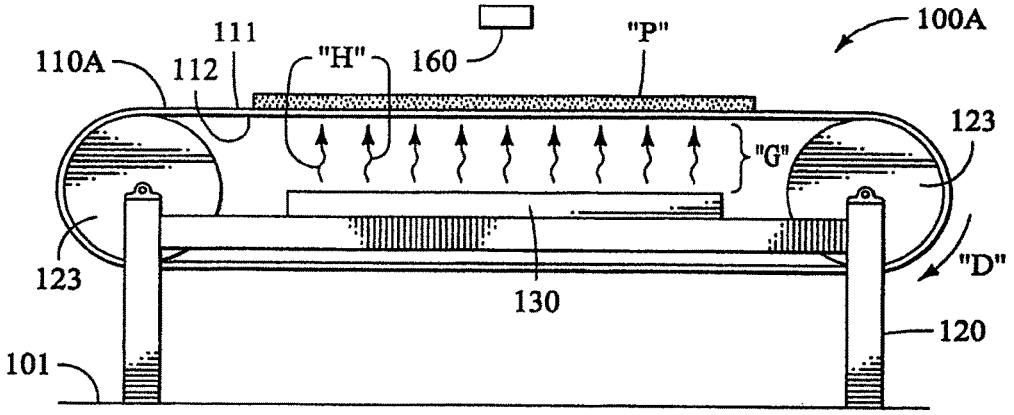
FIG. 3A is a side elevation diagram of an apparatus in accordance with a second embodiment of the present invention.

For example, referring to FIG. 3A, a side elevation diagram is shown of an apparatus 100A in accordance with a second embodiment of the present invention. As is evident, the support surface 110A of the apparatus 100A is configured as an endless belt comprising a flexible sheet supported by rollers 123. The support surface 110A can be configured to move, or circulate, in the direction "D."

The rollers 123 are, in turn, supported by the chassis 120A which also supports at least one heat source 130. The heat source 130 is configured to direct radiant heat "H" toward the second side 112 of the support surface 110A. Opposite the second side 112, is the first side 111 of the support surface 110A which is configured to movably support the product "P" thereon. As is seen, the configuration of the apparatus 100A can provide for continuous processing of the product "P."

Figure 3B:
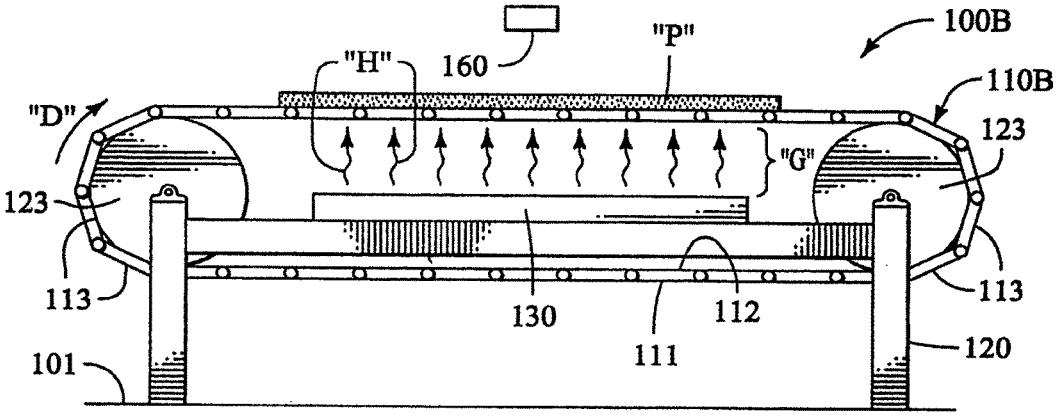
FIG. 3B is a side elevation diagram of an apparatus in accordance with a third embodiment of the present invention.

Turning now to FIG. 3B, a side elevation diagram is shown which depicts an apparatus 100B in accordance with a third embodiment of the present invention which is similar to the apparatus 100A discussed above for FIG. 3A. However, the support surface 110B of the apparatus 100B is not only configured as an endless belt, but also comprises a plurality of rigid links 113 which are pivotally connected to one another in a chain-like manner.

As shown, the apparatus 100B comprises a chassis 120 which rotatably supports rollers 123 thereon. The rollers 123 in turn movably support the support surface 110B thereon, which can be configured to move, or circulate, in the direction "D." The chassis 120 also supports a heat source 130 thereon which is configured to direct radiant heat "H" toward the second side 112 of the support surface 110B. The support surface 110B is configured to support the product "P" on the first side 111 which is opposite the second side 112.

Figure 3C:
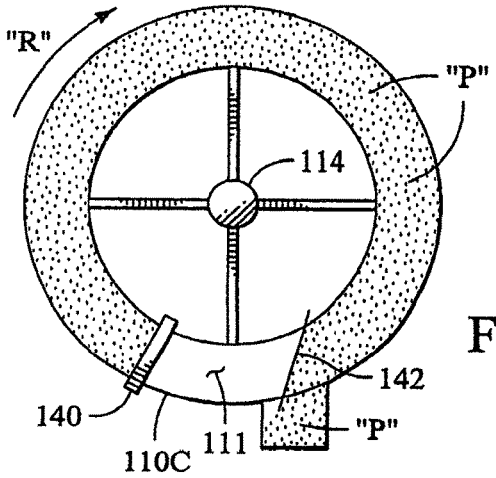
FIG. 3C is a top plan view of an apparatus in accordance with a fourth embodiment of the present invention.

Moving to FIG. 3C, a top plan view is shown of an apparatus 100C in accordance with a fourth embodiment of the present invention. In accordance with the apparatus 100C, the support surface 110C is substantially configured as a flat, horizontal ring which is configured to rotate in the direction "R." The support surface 110C' can be configured to rotate in the direction "R" about a center portion 114 which can comprise a bearing (not shown) or the like. The upper, or first, side 111 of the support surface 110A is configured to support the product "P" thereon.

The product "P" can be placed onto the first side 111 of the support surface 110A at an application station 140, and can be removed from the support surface at a removal station 142. At least one heat source (not shown) can be positioned beneath the support surface 110A such that radiant heat (not shown) is directed from the heat source to a lower, or second, side (not shown) which is opposite the first side 1111.

Returning now to FIG. 3, the apparatus 100 can comprise a controller 150 such as a digital processor or the like for executing operational commands. The controller can be in communication with the radiant heat source 130 by way of the control device 131 as well as at least one communication link 151. The communication link 151 can include either wire communication, or wireless communication means. The term "in communication with" means capable of sending or receiving data or commands in the form of signals which are passed via the communication link 151.

The apparatus 100 can also comprise a sensor 160 which can be supported by a ceiling 102 or other suitable support, and which can be in communication with the controller 150 by way of a communication link 151. The sensor 160 is configured to detect and measure at least one characteristic of at least a portion of the product "P." The characteristic can include, for example, the temperature of the product "P," the moisture content of the product, or the chemical composition of the product. The sensor 160 can be any of a number of sensor types which are known in the art. Preferably, the sensor 160 is either an infrared detector, or a bimetallic sensor.

The apparatus 100 can further include an operator interface 170 which is in communication with the controller 150 and which is configured to allow an operator to input commands or data into the controller 150 by way of a keypad or the like 172 which can be included in the operator interface. The operator interface 170 can also be configured to communicate information regarding the operation of the apparatus 100 to the operator by way of a display screen or the like 171 which can also be included in the operator interface. The controller can include an algorithm 153 which can be configured to automatically carry out various steps in the operation of the apparatus 100. The controller 150 can further include a readable memory 155 such as a digital memory or the like for storing data.

During operation of the apparatus 100, the product "P" can be placed upon the first side 111 of the support surface 110. Various means of placing the product "P" upon the first side 111 can be employed, including spraying, dripping, pouring, and the like. The operator of the apparatus 100 can input various data and commands to the controller 150 by way of the operator interface 170. These data and commands input by the operator can include the type of product "P" to be processed, the temperature profile to be maintained in the product, as well as "start" and "stop" commands.

The algorithm 153 can include at least one predetermined heat curve which is associated with at least one particular product "P." The term "heat curve" means a locus of values associated with the amount of heat produced by the heat source 130 and which locus of values is a function of elapsed time. After the operator identifies the particular product "P" and inputs this into the controller 150, the drying process, in accordance with temperature parameters dictated by the predetermined heat profile, can be carried out automatically. In addition, the drying process can be adjusted "on the fly" based on inputs from the sensor 160 received by the controller during the process, as described below.

Once the drying operation begins, the sensor 160 can detect and measure at least one characteristic of at least a portion of the product "P" such as the temperature, moisture content, or chemical composition thereof. The sensor 160 can be instructed by the controller 150, or otherwise configured, to repeatedly perform the detection and measurement of a characteristic of the product "P" at given intervals during the operation of the apparatus 100. Alternatively, the sensor 160 can be configured to continuously detect and measure the characteristic during the operation of the apparatus 100.

The measured characteristic which is detected and measured by the sensor 160 can be converted into a signal, such as a digital signal, and can then transmitted to the controller 150 by way of one of the communication links 151. The controller 150 can then receive the signal sent by the sensor 160, and can then store the signal as readable data in the readable memory 155. The controller 150 can then cause the algorithm 153 to be activated, wherein the algorithm can access the data in the readable memory 155 and then use the data to initiate an automatic operational command.

For example, the controller 150 can use the signal data sent by the sensor 160 to control the radiant heat source 130. That is, the controller 150 can use the signal data from the sensor 160 to control the amount of radiant energy "R" directed toward the support surface 110. This can be accomplished in various manners such as by turning the heat source on or off for specific time intervals, or by proportionally modulating the heat output produced by the energy source 130.

In a typical drying operation, for example, a product "P" can be placed onto the first side 111 of the support surface 110 as shown so as to be supported thereon. The operator can, by way of the interface 170, communicate to the controller 150 the type of product "P" which is to be dried. Alternatively, the operator can enter other data such as the estimated moisture content, or the like, of the product "P." The operator can also cause the apparatus 100 to commence a drying operation by entering a "start" command into the interface 170.

When the drying operation commences, the sensor 160 can detect and measure a characteristic of the product "P" such as the temperature, moisture content, or chemical composition thereof. The sensor 160 can then convert the measurement of the characteristic to a signal and then send the signal to the controller 150. For example, if the measured characteristic is the temperature of the product, then the sensor can send to the controller 150 a signal which contains data regarding the temperature of the product.

The controller 150 can use the data sent by the sensor 160 to regulate various functions of the apparatus 100. That is, the controller 150 can regulate the amount of radiant heat "H" produced by the radiant heat source 130 and directed to the product "P" as a function of the characteristic detected and measured by the sensor 160.

The controller 150 can also regulate the amount of radiant heat "H" produced by the radiant heater 130 as a function of elapsed time, as well as the particular type of product "P" which is to be dried. In alternative embodiments such as those described above for FIGS. 3A, 3B, and 3C, wherein the support surface 110 is configured to move the product "P" past the heat source 130, the controller 150 can regulate the speed at which the support surface 110, and thus the product, moves past the heat source.

The particular type of product "P" to be dried can have an optimum profile associated therewith, which, when adhered to, can optimize a given production result such as minimum drying time, or maximum quality of the product "P." The term "profile" means a locus of values of one or more measured product characteristics as a function of elapsed time. For example, a given product "P" can have associated therewith a given optimum temperature profile, an optimum moisture content profile, or an optimum chemical composition profile. The readable memory 155 can store optimum profiles for several types of products "P." Each of the stored optimum profiles can then be accessed by the algorithm 153 in accordance with instructions or commands entered into the controller 150 by the operator.

For example, the particular product "P" to be dried, for example, can have an optimum temperature profile that dictates an increase in the temperature of the product at a maximum rate possible and to a temperature of 100 degrees Centigrade. The optimum temperature profile can further dictate that, once the product "P" attains a temperature of 100 degrees Centigrade, the product temperature is to be maintained at 100 degrees Centigrade for an elapsed time of five minutes, after which the temperature of the product "P" is to decrease at a substantially constant rate to ambient temperature over an elapsed time often minutes.

The algorithm 153 can attempt to maintain the actual temperature of the product "P" so as to substantially match the optimum temperature profile stored in a given temperature profile of the product "P" by regulating the amount of heat energy "H" produced by the heat source 130. For example, in order to cause the temperature of the product "P" to increase rapidly so as to substantially match the optimum temperature profile, the algorithm 153 can cause the radiant heat source 130 to initially produce maximum output of radiant heat "H." This can be accomplished by causing the temperature of the heat source to increase rapidly to a relatively high level.

The heat energy "H" is directed from the heat source 130 to the second side 112 of the support surface 110. Because the support surface 110 in configured to allow the radiant heat "H" to pass there through, the product "P" will absorb at least a portion of the radiant heat. The absorption of the heat energy "H" by the product "P" results in an increased temperature of the product which, in turn, promotes moisture evaporation from the product. When the sensor 160 detects that the product "P" has reached a given temperature, such as 100 degrees Centigrade, the algorithm 153 can then begin a first elapsed time countdown having a given duration, such as five minutes.

During the first countdown, the algorithm 153, in conjunction with temperature measurements received from the sensor 160, can regulate the amount of heat output "H" produced by the radiant heat source 130 in order to maintain the temperature of the product "P" at a given temperature, such as 100 degrees Centigrade. For example, as moisture evaporates from the product "P," the product can require less heat energy "H" to maintain a given temperature. At the end of the first countdown, the algorithm 153 can then begin a second elapsed time countdown having a given duration, such as ten minutes.

During the second countdown, the algorithm 153 can control the heat output "H" of the radiant heat source 130 in accordance with the temperature measurements received from the sensor 160 in order to maintain an even decrease in the product temperature from, for example, 100 degrees Centigrade to ambient temperature, whereupon the drying operation is complete. Once the product "P," attains ambient temperature, or another given temperature, controller 150 can send a signal to the operator interface 170 which, in turn, can generate an audible or visual signal detectable by the operator. This audible or visual signal can alert the operator that the drying operation is complete.

The operator can then remove the finished, dried product "P" from the apparatus 100.

Figure 3D:
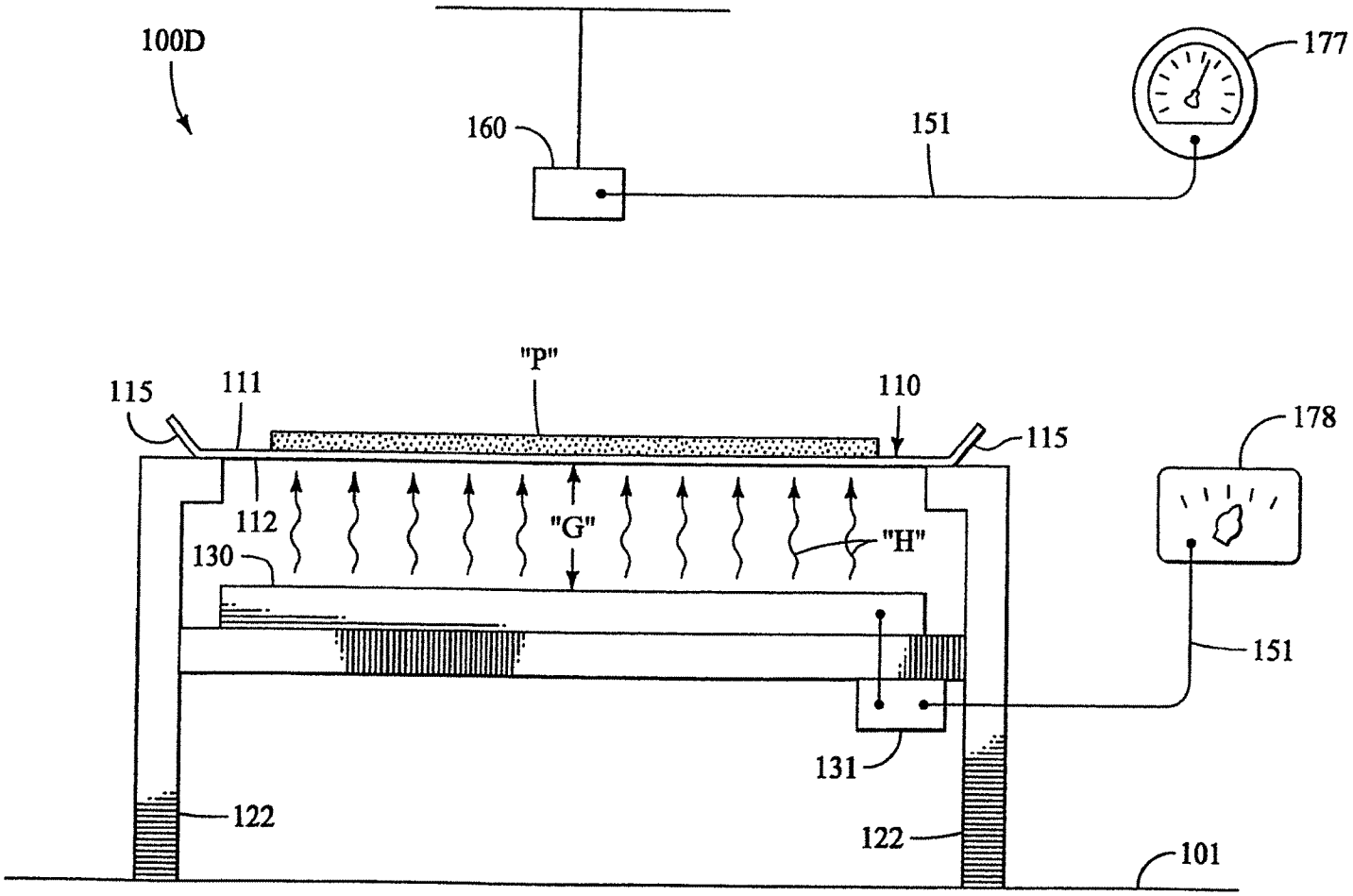
FIG. 3D is a side elevation diagram showing an alternative operational control scheme for the apparatus depicted in FIG. 3

Moving now to FIG. 3D, a side elevation diagram is shown of an apparatus 100D which is an alternate configuration in accordance with the first embodiment. The apparatus 100D depicts an alternative control scheme which can be used in place of that depicted in FIG. 3 for the apparatus 100. In accordance with the alternative control scheme which is depicted in FIG. 3D, the apparatus 100D can comprise a display 177 and a manual heat source control 178. The display 177 is connected to the sensor 160 by way of a communication link 151. The display is configured to display data relating to at least on characteristic of the product "P" which is detected and measured by the sensor 160.

The manual heat source control 178 is connected to the relay 131 by way of another communication link 151. The manual heat source control 178 is configured to receive operator input commands relating to the amount of heat "R" produced by the heat source 130. That is, the manual heat source control 178 can be set by the operator to cause the heat source 130 to produce a given amount of heat "R."

In operation, the operator can initially set the manual heat source control 178 to cause the heat source 130 to produce a given amount of heat "R." The manual heat source control 178 then sends a signal to the relay 131 by way of a communication link 151. The relay 131 then receives the Signal and causes the heat source 130 to produce the given amount of heat "H." The operator then monitors the display 177.

The sensor 160 can continually detect and measure a given characteristic of the product "P." The sensor can send a signal to the display 177 which relates to the measured characteristic. The display receives the signal and converts the signal to a value which it displays and which is readable by the operator. The operator can then adjust the heat "R" produced by the heat source 130 in response to the information relating to the measured characteristic which is read from the display 177.

As is seen, the apparatus 100, as well as the various other configurations thereof and related embodiments, can allow for much greater control of the amount of heat that is transferred to the product than can the various apparatus of the prior art. Because of this, the apparatus 100 of the present invention can produce products "P" having higher quality, and can produce the products in a more efficient manner, than the drying apparatus of the prior art.

As is further seen, the apparatus 100 can be suited for "batch" type of drying processes in which case the support surface 110 is not moved during the drying operation. In alternative embodiments such as those depicted in FIGS. 3A, 3B, and 3C, the support surface 110 can be configured to move the product "P" past the radiant heat source 130 and sensor 160, in which case a continuous drying process can be attained. In yet another embodiment of the present invention, which is described below, an apparatus 200 can be particularly suitable for producing a high-quality product in a high-output, continuous drying process.

Figure 4:
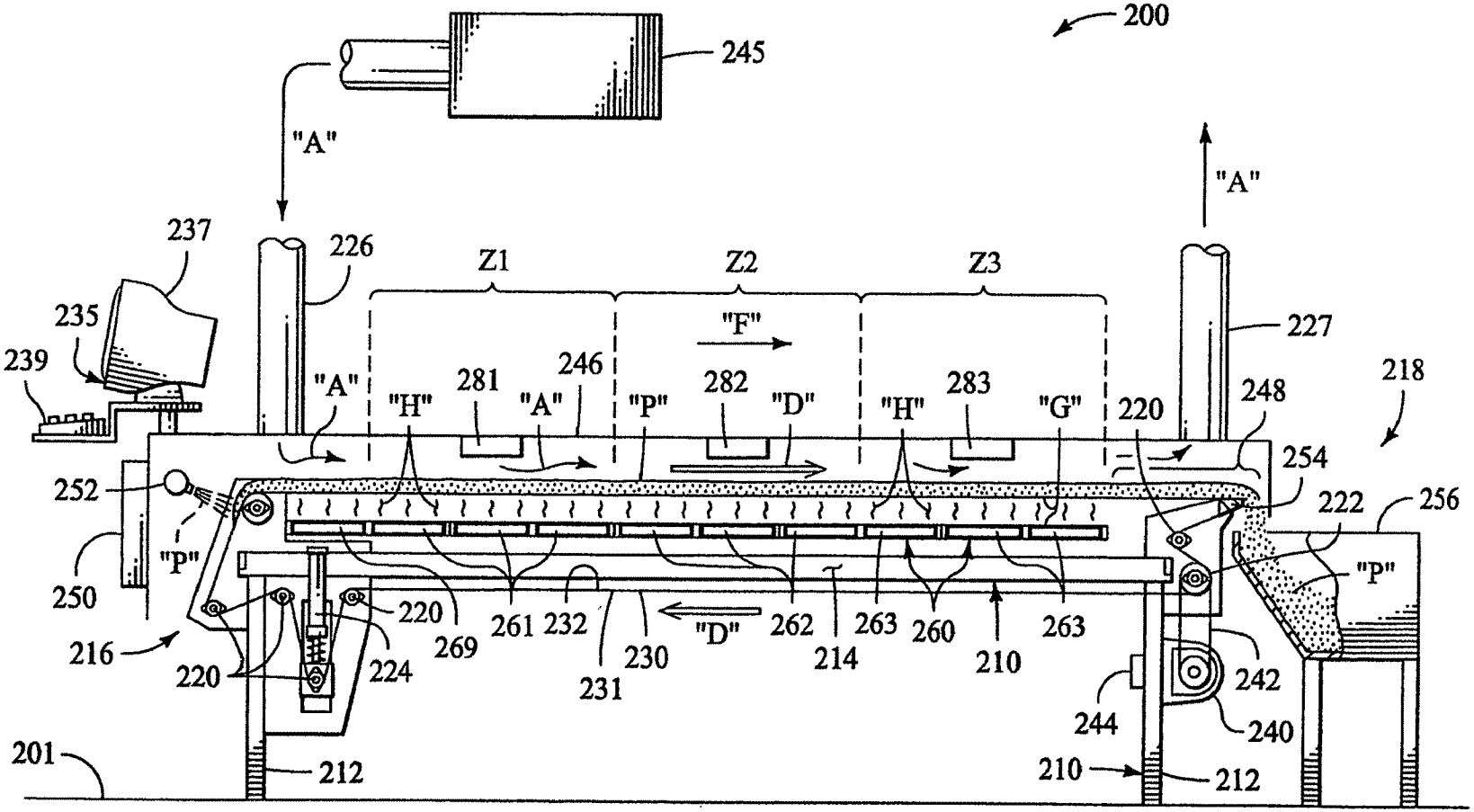
FIG. 4 is a side elevation diagram of an apparatus in accordance with a fifth embodiment of the present invention.

Referring to FIG. 4, a side elevation view of a drying apparatus 200 in accordance with a fifth embodiment of the present invention is depicted. The apparatus 200 comprises a chassis 210 which can be a rigid structure comprising various structural members including legs 212 and longitudinal frame rails 214 connected thereto. The legs 212 are configured to support the apparatus 200 on a floor 201 or other suitable base.

The chassis 210 can also comprise various other structural members, such as cross-braces (not shown) and the like. The chassis 210 can be generally constructed in accordance with known construction methods, including welding, fastening, forming and the like, and can be constructed from known materials such as aluminum, steel and the like. The apparatus 200 is generally elongated and has a first, intake end 216, and an opposite, distal, second, out feed end 218.

The apparatus 200 can further comprise a plurality of substantially parallel, transverse idler rollers 220 which are mounted on the chassis 210 and configured to rotate freely with respect thereto. At least one drive roller 222 can also be included in the apparatus 200 and can be supported on the chassis 210 in a substantially transverse manner as shown.

An actuator 240, such as an electric motor, can be included in the apparatus 200 as well, and can be supported on the chassis 210 proximate the drive roller 222. A drive linkage 242 can be employed to transfer prom the actuator 240 to the drive roller 222. A speed controller 244, such as an alternating current ("A/C") variable speed control device or the like, can be included to control the output speed of the actuator 240.

The apparatus 200 comprises a support surface 230, which has a first side 231 and an opposite second side 232. The support surface 230 is movably supported on the chassis 210. The support surface 230 is configured to allow radiant heat energy to pass there through from the second side 212 to the first side 211.

Preferably, the support surface 230 is fabricated from a material comprising plastic. More preferably, the support surface 230 is fabricated from a material selected from the group consisting of acrylic and polyester. Also, preferably, the support surface 230 is configured to withstand temperatures of up to at least 300 degrees Fahrenheit. The support surface 230 is configured as an endless flexible belt as shown, at least a portion of which can preferably be substantially flat and level.

As an endless belt form, the support surface 230 is preferably supported on the idler rollers 220 and drive roller 222. The support surface 230 can be configured to be driven by the drive roller 222 so as to move, or circulate, in the direction "D" relative to the chassis 210. As is seen, the support surface 230 can be configured so as to extend substantially from the intake end 216 to the out feed end 218. A take up device 224 can be supported on the chassis 210 and employed to maintain a given tension on the support surface 230.

The first side 231 of the support surface 230 is configured to support a layer of product "P" thereon as shown. The first side 231 is further configured to move the product "P" substantially from the intake end 216 to the out feed end 218. The product "P" can be in one of many possible forms, including liquid colloidal suspensions, solutions, syrups, and pastes. Is the case of a liquid product "P" having a relatively low viscosity, an alternative embodiment of the apparatus which is not shown can include a longitudinal, substantially upwardly-extending lip (similar to the lip 115 shown in FIG. 3) which can be formed on each edge of the support surface 230 to prevent the product from running off.

The product "P" can be applied to the first side 231 of the support surface 230 by an application device 252 which can be included in the apparatus 200 and which can be located proximate the intake end 216 of the apparatus 200. In the case of a liquid product "P," the product can be applied to the support surface 230 by spraying, as shown. Although FIG. 4 depicts a spraying method of applying the product "P" to the support surface 230, it is understood that other methods are equally practicable, such as dripping, brushing, and the like.

A removal device 254 can also be included in the apparatus 200. The removal device 254 is located proximate the out feed end 218, and is configured to remove the product "P" from the support surface 230. The product "P" can be in a dry or semi-dry state when removed from the support surface 230 by the removal device 254.

The removal device 254 can comprise a sharp bend in the support surface 230 as shown. That is, as depicted, the removal device 254 can be configured to cause the support surface 230 to turn sharply around a corner having a radius which is not more than about twenty times the thickness of the support surface 230. Also, preferably, the support surface 230 forms a turn at the removal device 254 which turn is greater than 90 degrees. More preferably, the turn is about between 90 degrees and 175 degrees.

The type of removal device 254 which is depicted can be particularly effective in removing certain types of product "P" which are substantially dry and which exhibit substantially self-adherence properties. It is understood, however, that other configurations of removal devices 254, which are not shown, can be equally effective in removing various forms of product "P" from the support surface, including scraper blades, low frequency vibrators, and the like. As the product "P" is removed from the support surface 230 at the out feed end 218, a collection hopper 256 can be employed to collect the dried product.

The apparatus 200 comprises a heater bank 260 which is supported on the chassis 210. The heater bank 260 comprises one or more first heat sources 261 and one or more second heat sources 262. The heater bank 260 can also comprise one or more third heat sources 263 and at least one preheater heat source 269. The heat sources 261, 262, 263, 269 are supported on the chassis 210 and are configured to direct radiant heat "H" across a gap "G" and toward the second side 232 of the support surface 230.

Each of the heat sources 261, 262, 263, 269 are dry radiant heat sources as defined above for FIG. 3. The heat sources 261, 262, 263, 269 are preferably selected from the group consisting of gas radiant heaters and electric radiant heaters. Furthermore, each of the heat sources 261, 262, 263, 269 is preferably configured to modulate, or incrementally vary, the amount of radiant heat produced thereby in a proportional manner. The operation of the heat sources 261, 262, 263, 269 is more fully described below.

The apparatus 200 can comprise an enclosure 246, such as a hood or the like, which is employed to cover the apparatus. The enclosure 246 can be configured to contain conditioned air "A" which can be introduced into the enclosure through an inlet duct 226. Before entering the enclosure, the conditioned air "A" can be processed in air conditioning unit (not shown) so as to have a temperature and humidity which is beneficial to drying of the product "P." The conditioned air "A" can circulate through the enclosure 246 before exiting the enclosure by way of an outlet duct 228. Upon exiting the enclosure 246, the conditioned air "A" can be returned to the air conditioning unit, or can be vented to exhaust.

The apparatus 200 can further comprise a first sensor 281, a second sensor 282, and a third sensor 283. It is understood that, although three sensors 281, 282, 283 are depicted, any number of sensors can be included in the apparatus 200. Each of the sensors 281, 282, 283 can be supported on the enclosure 246, or other suitable structure, in a substantially evenly spaced manner as shown. Each of the sensors 281, 282, 283 can be any of a number of sensor types which are known in the art. Preferably, in the case of detecting temperature of the product "P," each of the sensors 281, 282, 283 is either an infrared detector or a bimetallic sensor.

Preferably, the sensors 281, 282, 283 are positioned so as to be substantially exposed to the first side 231 of the support surface 230. The sensors 281, 282, 283 are configured to detect and measure at least one characteristic of the product "P" while the product is movably supported on the first side 231 of the support surface 230. Characteristics of the product "P" which are detectable and measurable by the sensors 281, 282, 283 can include the temperature, moisture content, and chemical composition of the product. Operational aspects of the sensors 281, 282, 283 are more fully described below.

The apparatus 200 can comprise a controller 250 for controlling various functions of the apparatus during operation thereof. The controller 250 can include any of a number of devices such as a processor (not shown), a readable memory (not shown), and an algorithm (not shown). The controller 250 will be discussed in further detail below. In addition to the controller 250, the apparatus 200 can include an operator interface 235 which can be in communication with the controller.

The operator interface 235 can be configured to relay information regarding the operation of the apparatus 200 to the operator by way of a display screen 237 such as a CRT or the like. Conversely, the operator interface 235 can also be configured to relay data or operational commands from the operator to the controller 250. This can be accomplished by way of a keypad 239 or the like which can also be in communication with the controller 250.

As is seen, a plurality of control zones Z1, Z2, Z3 are defined on the apparatus 200. That is, the apparatus 200 includes at least a first control zone Z1, which is defined on the apparatus between the intake end 216 and the out feed end 218. A second control zone Z2 is defined on the apparatus 200 between the first control zone Z1 and the out feed end 218. The apparatus 200 can include additional control zones as well, such as a third control zone Z3 which is defined on the apparatus between the second control zone Z2 and the out feed end. Each control zone Z1, Z2, Z3 is defined to be stationary relative to the chassis 210.

A study of FIG. 4 will reveal that each first heat source 261, as well as the first sensor 281 are located within the first control zone Z1. Likewise, each second heat source 262, and the second sensor 282, are located within the second control zone Z2. Each third heat source 263, and the third sensor 283, are located within the third control zone Z3. It is further evident that the support surface 230 moves the product "P" through each of the control zones Z1, Z2, Z3. That is, as the actuator 240 moves the support surface 230 in the direction "D," a given portion of the product "P" which is supported on the support surface, is moved successively through the first control zone ZI and then through the second control zone Z2.

After being moved through the second control zone Z2, the given portion of the product "P" can then be moved through the third control zone Z3 and on to the removal device 254. As is seen, at least a portion of the heater bank 260, such as the pre-heater heat source 269, can lie outside any of the control zones ZI, Z2, Z3. Furthermore, a cooling zone 248 can be defined relative to the chassis 210 and proximate the out feed end 218 of the apparatus 200. The cooling zone 248 can be configured to employ any of a number of known means of cooling the product "P" as the product 20 passes through the cooling zone.

For example, the cooling zone 248 can be configured to employ a refrigerated heat sink (not shown) such as a cold black body, or the like, which is exposed to the second side 232 of the support surface 230 and which positioned within the cooling zone. Such a heat sink can be configured to cool the product "P" by radiant heat transfer from the product and through the support surface 230 to the heat sink. One type of heat sink which can be so employed can be configured to comprise an evaporator coil which is a portion of a refrigeration system utilizing a fluid refrigerant such as Freon or the like.

It is understood that the cooling zone 248 can have a relative length which is different than depicted. It is further understood that other means of cooling can be employed. For example, the cooling zone 248 can be configured to incorporate a convection cooling system (not shown) in which cooled air is directed at the second side 232 of the support surface 230. Furthermore, the cooling zone 248 can be configured to incorporate a conductive cooling system (not shown) in which refrigerated rollers or the like contact the second side 232 of the support surface 230. The operation of the apparatus 200 can be similar to that of the apparatus 100 in accordance with the first embodiment of the present invention which is described above for FIG. 3, except that the product "P" is moved continuously past the heat sources 261, 262, 263, 269 and sensors 281, 282, 283. As depicted in FIG. 4, the product "P" can be applied to the first side 231 of the moving support surface 230 proximate the intake end 216.

The support surface 230 is driven by the actuator 240 by way of the drive link 242 and drive roller 222 so as to revolve in the direction "D" about the idler rollers 220. The product "P" can be in a substantially liquid state when applied to the support surface 230 by the application device 252. The product "P," which is to be dried by the apparatus 200, is fed there through in the feed direction "F" toward the out feed end 218.

The product "P," while supported on the support surface 230 and moved through the apparatus 200 in the direction "F," passes the heater bank 260 which can be positioned in substantially juxtaposed relation to the second side 232 of the support surface so as to be exposed thereto as shown. The heater bank 260 comprises one or more first heat sources 261 and one or more second heat sources 262 which are configured to direct radiant heat "H" toward the second side 232 and through the support surface 230 to heat the product "P" which is moved in the direction "F."

The heater bank 260 can also comprise one or more third heat sources 263 and one or more pre-heater heat sources 269 which are also configured to direct radiant heat "H" toward the second side 232 to heat the product "P." The product "P," while moving on the support surface 230 in the feed direction "F," is dried by the radiant heat "H" to a desired moisture content, and then removed from the support surface at the out feed end 218 by the removal device 254.

The product "P," once removed from the support surface 230, can be collected in a collection hopper 256 or the like for storage, packaging, or further processing. The support surface 230, once the product "P" is removed there from, returns to the intake end 216 whereupon additional product can be applied by the application device 252.

In order to promote efficient product drying as well as high product quality, conditioned air "A" can be provided by an air conditioning unit (HVAC) 245, and can be circulated about the product "P" by way of the enclosure 246, intake duct 226, and outlet duct 228 as the product is moved through the apparatus 200 in the feed direction "F" concurrent with the direction of the movement of the product.

As a further enhancement to production rate and product quality, a plurality of control zones can be employed. The term "control zone" means a stationary region defined on the apparatus 200 through which the product "P" is moved and in which region radiant heat is substantially exclusively directed at the product by one or more dedicated heat sources which are regulated independently of heat sources outside of the region. That is, a given control zone includes a dedicated servomechanism for controlling the amount of heat directed at the product "P" which is within the given control zone, wherein the amount of heat is a function of a measured characteristic of the product.

As is seen, the support surface 230 is configured to move the product "P" in succession through a first control zone ZI, and then through a second control zone Z2. This can be followed by a third control zone Z3. Within the first control zone Z1, one or more first heat sources 261 direct radiant heat "H" across the gap "G" toward the product "P" as the product moves through the first control zone. Likewise, within the second control zone Z2 and within the third control zone Z3, one or more second heat sources 262 and one or more third heat sources 263, respectively, direct radiant heat "R" across the gap "G" toward the product "P" as the product moves through the second and third control zones, respectively.

The temperature of, and thus the amount of heat "H" produced by, the first radiant heat sources 261 is regulated independently of the temperature of, and amount of heat produced by, the second heat sources 262. Similarly, the third heat sources 263 are regulated independently of the first and second heat sources 261, 262. The use of the control zones Z1, Z2, Z3 can provide for greater control of production parameters as compared to prior art devices.

That is, specific product profiles and heat curves can be attained with the use of the apparatus 200 because the product "P" can be exposed to different amounts of heat "H" in each control zone ZI, Z2, Z3. Specifically, for example, the first heat sources 261 can be configured to produce heat "R" at a first temperature. The second heat sources 262 can be configured to produce heat "H" at a second temperature which is different from the first temperature. Likewise, the third heat sources 263 can be configured to produce heat "H" at a third temperature.

Thus, as the product "P" proceeds through the apparatus in the feed direction "F," the product can be exposed to a different amount of heat "H" in each of the control zones Z1, Z2, Z3. This can be particularly useful, for example, in decreasing the drying time of the product "P" as compared to drying times in prior art apparatus. This can be accomplished by rapidly attaining a given temperature of the product "P" and then maintaining the given temperature as the product proceeds in succession through the control zones ZI, Z2, Z3. The use of the control zones Z1, Z2, Z3 can also be useful in providing tight control of the amount of heat "H" which is transmitted to the product "P" so as to provide greater product quality. That is, product quality can be enhanced by utilizing the control zones ZI, Z2, Z3 to minimize over-exposure and under-exposure of the product "P" to heat energy "H."

Assuming a given product "P" is relatively moist and at ambient temperature when placed onto the support surface 230 by the application device 252, a relatively large amount of heat "H" is required to raise the temperature of the product to a given temperature such as 100 degrees Centigrade. Thus, a pre-heater heat source 269 can be employed to pre-heat the product "P" before the product enters the first control zone ZI. The pre-heater heat source 269 can be configured to continually produce radiant heat "H" at a maximum temperature and to direct a maximum amount of heat "H" to the product "P."

As the product "P" enters the first control zone Z1, the first heat sources 261 within the first control zone Z1 can be configured to produce an amount of heat "H" which sufficient to attain the given desired product temperature. The first sensor 281, in conjunction with the controller 250, can be employed to regulate the temperature of the first heat sources 261 in order to transfer the desired amount of heat "H" to the product "P." The first sensor 281 is configured to detect and measure at least one given characteristic of the product "P" while the product is within the first control zone Z1. For example, the first sensor 281 can be configured to detect and measure the temperature of the product "P" while the product is within the first control zone ZI.

The first sensor 281 can detect and measure a characteristic of the product "P" while the product is in the first control zone Z1 and then relay that measured characteristic to the controller 250. The controller 250 can then use the measurement from the first sensor 281 to modulate the temperature, or heat output, of the first heat sources 261. That is, the heat "H" produced by the first heat sources 261 can be regulated as a function of a measured product characteristic of the product "P" within the first control zone Z1 as detected and measured by the first sensor 281. This measured product characteristic can include, for example, the temperature of the product.

The second sensor 282 is similarly employed to detect and measure at least one characteristic of the product "P" while the product is within the second control zone Z2. Likewise, the third sensor 283 can be employed to detect and measure at least one characteristic of the product "P" while the product is within the third control zone Z3.

The product characteristics detected and measured by the second and third sensors 282, 283 within the second and third control zones Z2, Z3, respectively, can be likewise utilized to modulate the amount of heat "H" produced by the second and the third heat sources 262, 263 to maintain a specific temperature profile of the product "P" as the product progresses through each of the control zones.

In the case wherein the product "P" is heated rapidly to a given temperature and then maintained at the given temperature, the first heat sources 261 will likely produce heat "H" at a relatively high temperature in' order to rapidly increase the product temperature to the given temperature by the time the product "P" leaves the first zone Z1. Assuming that the product "P" is at the given temperature when entering the second control zone Z2, the second and third heat sources 262, 263 will produce heat "H" at a successively lower temperatures because less heat "H" is required to maintain the temperature of the product as the moisture content thereof decreases.

As mentioned above, the sensors 281,282,283 can be configured to detect and measure any of a number of product characteristics, such as moisture content. This can be particularly beneficial to the production of a high-quality product "P." For example, in the above case wherein the product temperature has reached the given temperature as the product "P" enters the second control zone Z2, the second and third sensors 282, 283 can detect and measure product moisture content as the product progresses through the respective second and third control zones Z2, Z3.

If the second sensor 282 detects and measures a relatively high product moisture content of the product "P" within the second control zone Z2, then the controller 250 can modulate the second heat sources 262 so as to continue to maintain the product temperature at the given temperature in order to continue drying of the product. However, if the second sensor 282 detects a relatively low product moisture content, then the controller 250 can modulate the second heat sources 262 so as to reduce the product temperature in order to prevent over-drying the product "P."

Likewise, the third sensor 283 can detect and measure product moisture content within the third control zone Z3, whereupon the controller can determine the proper amount of heat "H" to be produced by the third heat sources 263. Although three control zones ZI, Z2, Z3 are depicted, it is understood that any number of control zones can be incorporated in accordance with the present invention.

In furtherance of the description of the interaction between the controller 250, the sensors 281,282,283, and the heat sources 261, 262, 263 provided by the above example, a given control zone ZI, Z2, Z3 can be described as a separate, independent, and exclusive control loop which comprises each associated sensor and each associated heat source located within the given control zone, and which is, along with the controller, configured to independently regulate the amount of heat "H" produced by the associated heat sources as a function of at least one characteristic of the product "P" measured by the associated sensor.

That is, each sensor 281, 282, 283 associated with a given control zone Z1, Z2, Z3, can be considered as configured to provide control feedback to the controller 250 exclusively with regard to characteristics of a portion of the product "P" which is in the given control zone. The controller 250 can use the feedback to adjust the output of the heat sources 261, 262, 263 in accordance with a temperature profile or other such parameters defined by the operator or otherwise stored within the controller.

In addition to decreasing the drying time of the product "P" as compared to prior art drying apparatus, the plurality of control zones ZI, Z2, Z3 of the apparatus 200 can also be employed to attain specific product profiles which can be beneficial to the quality of the product as described above for the apparatus 100.

For example, it can be assumed that the quality of a given product "P" can be maximized by following a given product temperature profile during drying. The given product temperature profile can dictate that, as the product "P" passes successively through the first, second, and third control zones ZI, Z2, Z3, the temperature of the product initially increases rapidly to a maximum given temperature, whereupon the temperature of the product "P" gradually decreases until it is removed from the support surface 23U. In that case, the first sensor 281, first heat sources 261 and controller 250 can operate in a manner similar to that described above in order to rapidly increase the product "P" temperature to a first temperature which can be reached as the product "P" passes through the first control zone Z1. The first temperature can correspond to a relatively large amount of heat "H" which is transferred to the product "P" which initially contains a high percentage of moisture.

As the product "P" passes through the second control zone Z2, the second sensor 282, second heat sources 262 and controller 250 can operate to decrease the product temperature to a relatively medium second temperature which is lower than the first temperature. The second temperature can correspond to a lesser amount of heat "H" which is required as the moisture content of the product "P" drops.

Likewise, as the product "P" passes through the third control zone Z3, the third sensor 283, third heat sources 263 and controller 250 can operate to decrease the product temperature further to a relatively low third temperature which is lower than the second temperature. The third temperature can correspond to a relatively low amount of heat "H" which is required as the product "P" approaches the desired dryness.

In addition to regulating the temperature of the heat sources 261,262,263, the controller 250 can also be configured to regulate the speed of the support surface 230 relative to the chassis 210. This can be accomplished by configuring the controller 250 so as to modulate the speed of the actuator 240. For example, as in the case where the actuator 240 is an A/C electric motor, the controller can be configured so as to modulate the variable speed control unit 244 by way of a servo or the like.

The speed or rate of movement, of the support surface 230 can affect the process of drying the product "P" which is performed by the apparatus 200. For example, a relatively slow speed of the support surface 230 can increase the amount of heat "H" which is absorbed by the product "P" because the slower speed will cause the product to be exposed to the heat "H" for a longer period of time. Conversely, a relatively fast speed of the support surface 230 can decrease the amount of heat "H" which is absorbed by the product "P" because the faster speed will result in less exposure time during which the product is exposed to the heat.

Moreover, the controller 250 can also be configured to regulate various qualities of the conditioned air "A" which can be made to circulate through the enclosure 246. For example, the controller 250 can be made to regulate the flow rate, relative humidity, and temperature of the conditioned air "A." These qualities of the conditioned air "A" can have an affect on both the drying time and quality of the product "P."

In another alternative embodiment of the apparatus 200 which is not shown, the enclosure 246 can be configured so as to be substantially sealed against outside atmospheric air. In that case, the chemical composition of the conditioned air "A" can be controlled so as to affect the drying process in specific manners, or to affect or preserve the chemical properties of the product "P." For example, the conditioned air "A" can substantially be inert gas which can act to prevent oxidation of the product "P."

Figure 5:
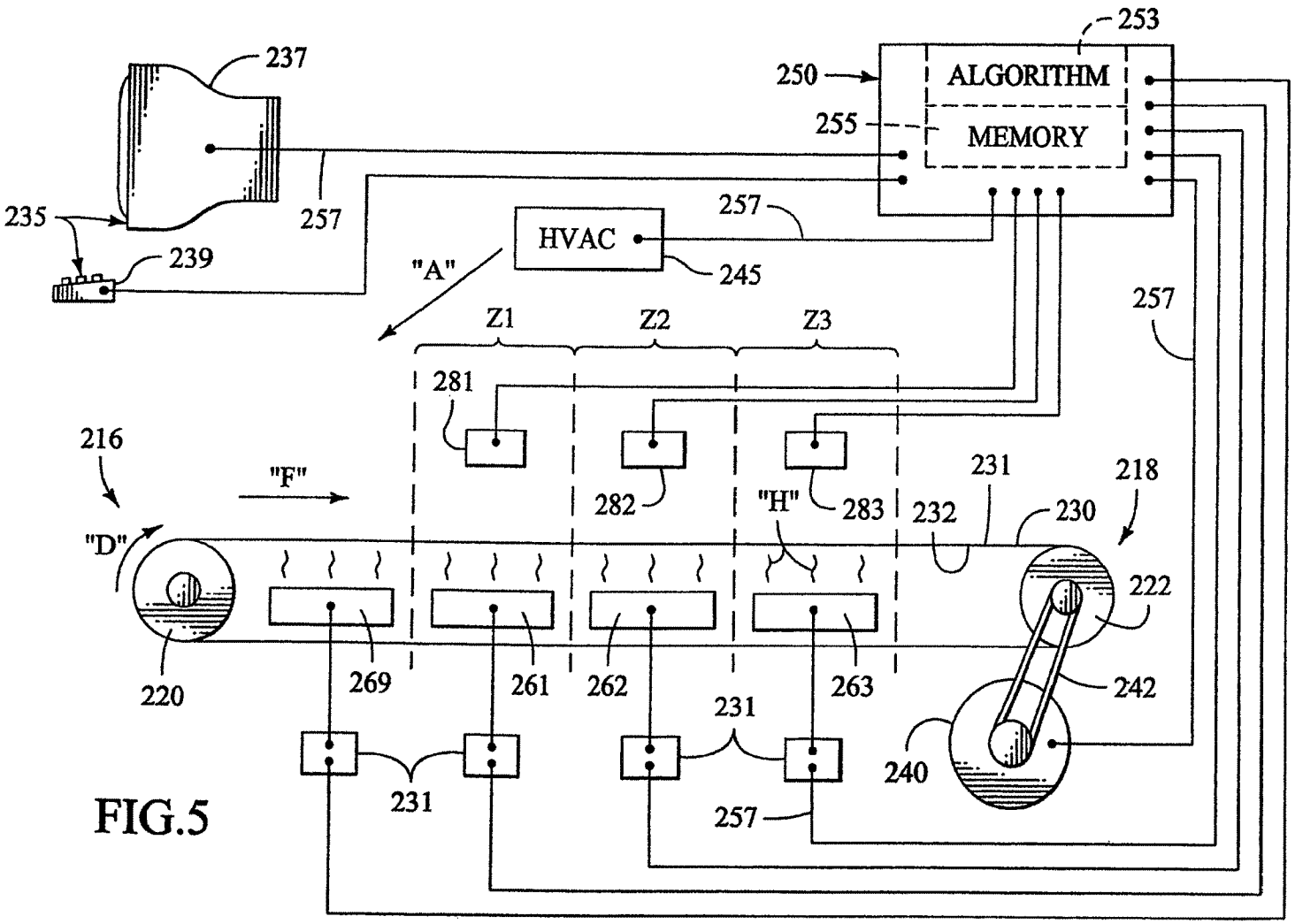
FIG. 5 is a schematic diagram showing one possible configuration of communication links between the various components of the apparatus depicted in FIG. 4.

Moving to FIG. 5, a schematic diagram is shown which depicts one possible configuration of the apparatus 200 which comprises a plurality of communication links 257. The communication links 257 are configured to provide for the transmission of data signals between the various components of the apparatus 200. The communication links 257 can be configured as any of a number of possible communication means, including those of hard wire and fiber optic. In addition, the communication links 257 can comprise wireless communication means including infrared wave, micro wave, sound wave, radio wave and the like.

A readable memory storage device 255, such as a digital memory, can be included within the controller 250. The readable memory device 255 can be employed to store data regarding the operational aspects of the apparatus 200 which are received by the controller by way of the communication links 257, as well as set points and other stored values and data which can be used by the controller 250 to control the drying process. The controller 250 can also include at least one algorithm 253 which can be employed to carry out various decision-making processes required during operation of the apparatus 200.

The decision-making processes taken into account by the algorithm 253 can include maintaining integrated coordination of the several variable control aspects of the apparatus 200. These variable control aspects comprise the speed of the support surface 230, the amount of heat "H" produced by each of the heat sources 261, 262, 263, 269, and the product characteristic measurements received from the sensors 281, 282, 283. Additionally, the algorithm 253 can be required to carry out the operational decision-making processes in accordance with various set production parameters such as a product temperature profile and production rate.

The communication links 257 can provide data transmission between the controller 250 and the operator interface 235 which can comprise a display screen 237 and a keypad 239. That is, the communication links 257 between the controller 250 and operator interface 235 can provide for the communication of data from the controller to the operator by way of the display screen. Such data can include various aspects of the apparatus 200 including the temperature and moisture content of the product "P" with regard to the position of the product within each of the control zones ZI, Z2, Z3.

Additionally, such data can include the speed of the support surface with respect to the chassis 210 and the temperature of each of the heat sources 261, 262, 263, 269. The communication links 257 can also provide for data to be communicated from the operator to the controller 250 by way of the keypad 239 or the like. Such data can include operational commands including the specification by the operator of a given product temperature profile.

A communication link 257 can be provided between the controller 250 and the HV AC unit 245 so as to communicate data there between. Such data can include commands from the controller 250 to the HV AC unit 245 which specify a given temperature, humidity, or the like, of the conditioned air "A." A communication link 257 can also be provided between the controller 250 and the actuator 240 so as to communicate data there between. This data can include commands from the controller 250 to the actuator which specify a given speed of the support surface 230.

Additional communication links 257 can be provided between the controller 250 and each 20 of the sensors 281, 282, 283 so as to communicate data between each of the sensors and the controller. Such data can include measurements of various characteristics of the product "P" as described above for FIG. 4. Other communication links 257 can be provided between the controller 250 and each of the heat sources 261, 262, 263, 269 so as to provide transmission of data there between.

This data can include commands from the controller 250 to each of the heat sources 261,262, 263,269 which instruct each of the heat sources as to the amount of heat "H" to produce. As can be seen, the apparatus 200 can include a plurality of control devices 231, wherein one each of the control devices is connected by way of respective communication links 257 to the controller 250. Each of the control devices can be configured in the manner of the control device 131 which is described above for FIG. 3. In accordance with a sixth embodiment of the present invention, a method of drying a product includes providing a support surface which has a first side, and an opposite second side, and supporting the product on the first side while directing radiant heat toward product. Preferably, the support surface can allow radiant heat to pass there through so as to heat the product. The support surface can be a substantially flexible sheet. Alternatively, the support surface can be substantially rigid.

The method can further include the step of measuring a characteristic of the product, along with regulating the amount of radiant heat directed toward the second side as a function of the measured characteristic. The measured characteristic can include the temperature of the product, the moisture content of the product, and the chemical composition of the product. The characteristic can be detected and measured intermittently at given intervals, or it can be measured continually over a given time interval.

The method can also include moving the support surface so as to move the product past the heat source. Alternatively, the method can include moving the support surface so as to move the product through a plurality of control zones in succession, and providing a plurality of heat sources, wherein each control zone has at least one associated heat source dedicated exclusively to directing radiant heat within the associated control zone.

In other words, the method can include regulating the temperature of the heat sources within any given control zone independently of the temperature of any other heat sources outside the given control zone. This can allow producing and maintaining a given temperature profile of the product as the product is moved through the control zones.

The method can further include providing a plurality of sensors, wherein any given control zone has at least one sensor dedicated exclusively to detecting and measuring at least one characteristic of the product within the given control zone. This can allow regulating the temperature of each heat source in any given control zone as a function of at least one characteristic of the product within the given control zone. As noted above, the characteristics can include the temperature, moisture content, and chemical composition of the product, among others.

The rate of movement of the support surface relative to the control zones can also be regulated in accordance with the method. Additionally, an enclosure can be provided to aid in circulating conditioned air about the product as the product is processed by the apparatus. The quality of the conditioned air can be controlled, wherein such qualities can include the temperature, humidity, and chemical makeup of the conditioned air. The method can include annealing the product which the product is supported on the support surface.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A method of drying liquid products, comprising:

selecting a temperature profile from a plurality of temperature profiles corresponding to a plurality of liquid products, wherein the plurality of temperature profiles are stored in a readable memory, wherein the selected temperature profile corresponds to a selected liquid product to be dried;

applying a layer of the selected liquid product onto a product support side of a support surface with the product support side and an opposite side;

directing radiant heat at the opposite side of the support surface from one or more dry radiant heat sources located below the support surface;

moving the support surface relative to the one or more dry radiant heat sources to convey the selected liquid product past one or more of the dry radiant heat sources, which heat the selected liquid product and cause moisture to be removed therefrom, wherein the selected liquid product is heated only by dry radiant heat sources located below the support surface; and maintaining the selected temperature profile of the selected liquid product as it is conveyed past the one or more dry radiant heat sources.

2. The method of claim 1, wherein the selected liquid product comprises a liquid colloidal suspension, a solution, a syrup, or a paste.

3. The method of claim 1, wherein the selected liquid product comprises a liquid food product comprising a liquid colloidal suspension, a solution, a syrup, or a paste.

4. The method of claim 1, wherein the selected liquid product is heated to a temperature of up to 100 degrees, Centigrade.

5. The method of claim 1, wherein the selected liquid product is dried to a desired moisture content and self-adheres to the support surface, and the method further comprises removing dried selected liquid product from the support surface with a product removal device.

6. The method of claim 5, wherein the support surface moves partially around and slides against a corner positioned adjacent the opposite side of the support surface and the product removal device is positioned adjacent the support side of the support surface opposite the corner such that as the support surface moves between the corner and the product removal device, dried selected liquid product is removed from the support surface.

7. The method of claim 6, wherein the corner defines a turning radius for the support surface that is not more than twenty times the thickness of the support surface.

8. The method of claim 7, wherein the support surface turns between 90degrees and 175 degrees when passing over the corner.

9. The method of claim 6, wherein the support surface conveys the selected liquid product in a conveying direction and the corner has a flat surface that is oriented at an angle greater than 90 degrees with respect to the conveying direction such that the corner causes the support surface to turn greater than 90 degrees when passing over the flat surface.

10. The method of claim 1, further comprising flowing conditioned air over the selected liquid product supported on the support surface to promote drying of the selected liquid product, wherein the conditioned air flows over the selected liquid product and upwardly through an outlet of a hood positioned over the support surface, wherein the conditioned air is conditioned and supplied to the hood from an air conditioning unit located outside the hood.

11. The method of claim 10, wherein the conditioned air flows over the selected liquid product and upwardly through the outlet of the hood positioned over the support surface.

12. The method of claim 10, further comprising regulating the flow rate of the conditioned air flowing over the selected liquid product.

13. The method of claim 10, further comprising regulating humidity of the conditioned air flowing over the selected liquid product from the air conditioning unit so as to obtain a predetermined humidity of the conditioned air that is beneficial to drying the selected liquid product.

14. The method of claim 10, further comprising regulating the temperature of the conditioned air flowing over the selected liquid product from the air conditioning unit so as to obtain a predetermined temperature of the conditioned air that is beneficial to drying the selected liquid product.

15. The method of claim 1, wherein the selected temperature profile comprises a first phase of increasing temperature of the liquid product to a maximum temperature with a maximum rate, a second phase of maintaining the maximum temperature of the liquid product for a predefined duration, and a third phase of decreasing temperature of the selected liquid product to an ambient temperature at a substantially constant rate.

16. The method of claim 1, wherein the act of maintaining the selected temperature profile comprises monitoring the temperature of the selected liquid product on the support surface with a temperature sensor, and controlling the one or more dry radiant heat sources with a controller, which is in communication with the temperature sensor and modulates the one or more dry radiant heat sources to regulate the amount of radiant heat directed toward the support surface in response to measurements made by the temperature sensor such that the temperature of the selected liquid product varies in a temporal pattern defined by the selected temperature profile.

17. The method of claim 16, wherein the one or more dry radiant heat sources are arranged in a plurality of control zones, each control zone comprising one or more dry radiant heat sources;

the temperature of the selected liquid product in each control zone is monitored with a temperature sensor within each control zone and in communication with the controller;

the controller proportionally modulates the one or more dry radiant heat sources in each control zone independently in direct proportion to measurements made by the temperature sensors.

18. The method of claim 1, wherein the one or more dry radiant heat sources are arranged in a plurality of control zones, and wherein the temperature profile comprises a first phase of increasing temperature of the selected liquid product to a first temperature in a first control zone, a second phase of decreasing temperature of the selected liquid product to a second temperature that is lower than the first temperature in a second control zone, and a third phase of decreasing temperature of the selected liquid product to a third temperature that is lower than the second temperature in a third control zone.

19. A method of drying a product, comprising:

selecting a temperature profile from a plurality of temperature profiles corresponding to a plurality of products, each temperature profile defining a locus of temperature values as a function of elapsed time, wherein the plurality of temperature profiles are stored in a readable memory, wherein the selected temperature profile corresponds to a selected product to be dried;

applying the selected product onto a product support side of a support surface with the product support side and an opposite side;

directing radiant heat at the opposite side of the support surface from one or more dry radiant heat sources located below the support surface, wherein there is no other source heating the selected product besides the one or more dry radiant heat sources;

moving the support surface relative to the one or more dry radiant heat sources to convey the selected product past one or more of the dry radiant heat sources, which heat the selected product and cause moisture to be removed therefrom;

monitoring the temperature of the selected product on the support surface with a temperature sensor; and implementing the selected temperature profile via a controller, which is in communication with the temperature sensor and modulates the one or more dry radiant heat sources to regulate the amount of radiant heat directed toward the support surface and a speed of the support surface relative to the one or more dry radiant heat sources in response to measurements made by the temperature sensor, so as to maintain the temperature profile of the selected product.

20. The method of claim 19, wherein the one or more dry radiant heat sources are controlled by a proportional control system in which the controller modulates the temperature of the one or more dry radiant heat sources to regulate the amount of radiant heat directed toward the support surface in direct proportion to measurements made by the temperature sensor.

21. The method of claim 19, wherein the one or more dry radiant heat sources are controlled by an on/off control system in which the controller controls the one or more dry radiant heat sources to turn on and off to regulate the amount of radiant heat directed toward the support surface in response to measurements made by the temperature sensor.

22. The method of claim 19, wherein the one or more dry radiant heat sources cause the selected product to be dried to a desired moisture content such that it self-adheres to the support surface.

23. The method of claim 19, wherein the selected product is heated to a temperature of up to 100 degrees, Centigrade.

24. The method of claim 19, further comprising drawing conditioned air over the selected product supported on the support surface, wherein the conditioned air flows over the selected product and upwardly through an outlet of a hood positioned over the support surface, wherein the conditioned air is conditioned and supplied to the hood from an air conditioning unit located outside the hood, and wherein the conditioned air, before entering the hood, is conditioned to a predetermined humidity and a predetermined temperature that are beneficial to drying the selected product.

25. The method of claim 24, wherein a hood positioned over the support surface draws conditioned air over the selected product and upwardly through an outlet.

26. The method of claim 20, wherein:

the one or more dry radiant heat sources are arranged in a plurality of control zones, each control zone comprising one or more dry radiant heat sources;

the temperature of the selected product in each control zone is monitored with a temperature sensor within each control zone and in communication with the controller;

the controller proportionally modulates the one or more dry radiant heat sources in each control zone independently in direct proportion to measurements made by the temperature sensors.

27. The method of claim 19, wherein the one or more radiant heat sources comprise quartz heaters, ceramic heaters, or natural gas heaters.

28. The method of claim 20, wherein the proportional control system comprises an electrical relay in communication with the one or more dry radiant heat sources and the controller.

29. The method of claim 19, wherein the temperature profile comprises a first phase of increasing temperature of the selected product to a maximum temperature with a maximum rate, a second phase of maintaining the maximum temperature of the selected product for a predefined duration, and a third phase of decreasing temperature of the selected product to an ambient temperature at a substantially constant rate.

* * * * *